United States Patent [19]

Bryant

[11] Patent Number: 4,727,737

[45] Date of Patent: Mar. 1, 1988

[54] METHOD AND APPARATUS FOR BENDING A HEAT EXCHANGER COIL

[75] Inventor: Ralph S. Bryant, Brentwood, Tenn.

[73] Assignee: Heil-Quaker Home Systems, Inc., Lavergne, Tenn.

[21] Appl. No.: 948,125

[22] Filed: Dec. 31, 1986

[51] Int. Cl.[4] ..... B21D 7/04

[52] U.S. Cl. ..... 72/153

[58] Field of Search ..... 72/149, 153, 154, 155, 72/156, 319, 320, 321

[56] References Cited

U.S. PATENT DOCUMENTS

| | | | |
|---|---|---|---|
| 1,264,249 | 4/1918 | Yoder | 72/295 |
| 2,667,202 | 1/1954 | Froedge | 72/156 |
| 2,812,004 | 11/1957 | Huet | 72/154 |
| 3,287,952 | 11/1966 | Van Harten | 72/153 X |
| 3,443,296 | 5/1969 | Clausing | 72/306 X |
| 3,553,989 | 1/1971 | Munro | 72/8 |
| 3,785,190 | 1/1974 | Schall et al. | 72/149 |
| 3,958,440 | 5/1976 | Sassak | 72/321 X |

FOREIGN PATENT DOCUMENTS

| | | | |
|---|---|---|---|
| 1089621 | 9/1960 | Fed. Rep. of Germany | 72/153 |
| 2111416 | 7/1983 | United Kingdom | 72/153 |

*Primary Examiner*—E. Michael Combs

*Attorney, Agent, or Firm*—Jeffers, Hoffman & Niewyk

[57] ABSTRACT

A method and apparatus for bending a heat exchanger coil, and particularly a fin-on-tube coil, is provided which reduce pressure on the coil at a bending location to prevent damage to the fins and coil by effecting relative movement between a support bed for the coil, defining a coil plane, and a rotating mandrel, in a direction perpendicular to the coil plane during approximately the first 10° of rotation of the mandrel. Such relative movement can be accomplished by either moving the support bed or by moving the rotational axis of the mandrel.

16 Claims, 10 Drawing Figures

METHOD AND APPARATUS FOR BENDING A HEAT EXCHANGER COIL

BACKGROUND OF THE INVENTION

1. Field of the Invention

The present invention relates to a metal bending apparatus, and more specifically an apparatus and method for bending a heat exchanger coil comprised of a plurality of tubes with plate-like fins carried thereon.

2. Description of the Prior Art

Heat exchanger coils are generally composed of a plurality of tubes which preferably carry fins to increase the surface area and to thereby increase the efficiency of the heat exchange provided by the tubes between a fluid flowing within the tubes and a fluid flowing around the outside of the tubes. Generally, the tubes are originally formed in a linear fashion and the fins are attached to the tubes while the tubes are in such a linear state. Subsequently, it is often desirable to provide one or more bends in the tubes in order to shape the coil to various assembled environments, for example, the coil may have one or more right angle bends to generally form a rectangular perimeter in an assembled condition.

A number of methods and apparatus for bending coils and, in particular, heat exchanger coils with fins, have been proposed in prior art. For example, U.S. Pat. No. 3,443,296 discloses a coil bender that clamps the coil in two places and applies a bending motion that decreases in radius over the entire bend.

U.S. Pat. No. 3,785,190 discloses a tube bender having a spindle 12 around which the tube is deformed, and a linear clamp shoe 30 which moves with the tube during the bend.

U.S. Pat. No. 3,958,440 discloses a die block that is laterally retractable to an inoperative position between bends and U.S. Pat. No. 2,667,202 discloses a clamping die 43 which moves synchronously with a die wheel 24 and stop 74 to restrain a portion of the tube during the bend.

Problems develop during the bending of a coil, especially when fins are carried on the tubes in that pressure tends to build up on the inside bend radius which can cause the fins to deform during the bending process since the bend normally occurs around a mandrel. This deformation of fins is more pronounced in fins having enhancements formed in the surfaces, which tend to weaken the fin.

SUMMARY OF THE INVENTION

It is an object of the present invention to provide a method and apparatus to put bends into fin on tube heat exchanger coils especially ones having enhanced fins, that is fins which have a non-planar shape, which are more susceptible to damage, without damaging the fins. A further object is to provide such a method and apparatus that can bend both single row and dual row heat exchangers, that is, heat exchangers which have either one or two rows of tubes, each row carrying fins. It is yet a further object of the present invention to rapidly provide multiple bends to produce an essentially box-shaped heat exchanger having accurately formed bends.

The present invention is usable with either a single row fin on tube heat exchanger or a dual-row unit that initially starts out with two single row units, separated by a flexible plastic sheet and secured together at a leading edge.

The coil, which is generally comprised of a plurality of side by side tubes and, may be stacked to be two rows of tubes thick, is supported on an in-feed bed or conveyor for relatively free longitudinal movement. A hold-down holds the coil in contact with the feed bed in a coil plane and it may move longitudinally with the tubes as they move along the in feed bed. A first end of the tubes which, in the case of a stacked set of tubes has the stacks secured together, is clamped between a mandrel and a movable clamp member. The mandrel is free to pivot about an axis and the clamp also pivots about the same axis so that the tubes are held against the mandrel as the mandrel rotates. The mandrel has a curved lobe surface which induces an appropriate bend in the tubes.

The present invention provides a means for relieving the pressure on the inside radius of the bends, particularly during the critical initial bending of the tubes whereby there is a relative displacement between the feed bed and mandrel perpendicular to the coil plane during approximately the first ten degrees of bend of the coil. This relative perpendicular movement can be accomplished by a sliding of the mandrel and clamp in the perpendicular direction, which is in the direction toward which the bend is occurring, so that in effect the mandrel is being moved away from the inner surface of the finned coil as the bend is beginning. Conversely, the in-feed bed and hold-down may be moved in a perpendicular direction away from the direction of bend thus lifting the coil away from the mandrel during the initial bending step.

A plastic sheet is provided between the stacked coils and the second ends of the coils are left unattached relative to one another so that a sliding movement can occur between the two sets of coils thus avoiding any binding of the coils during the bending operation.

DESCRIPTION OF THE PREFERRED EMBODIMENTS

Figure 1:
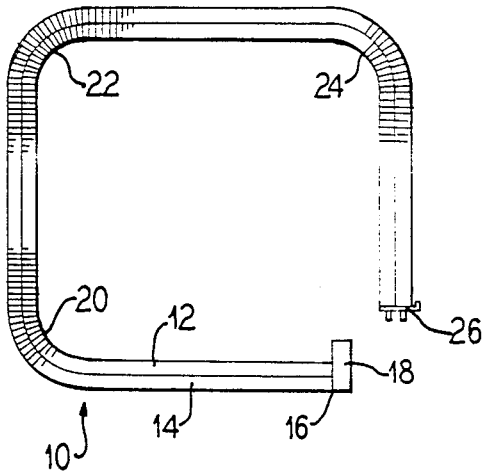
FIG. 1 is a schematic illustrational view of a dual-row tube on fin heat exchanger in a completely bent configuration.

In FIG. 1 there is illustrated generally at 10 a dual row fin on tube heat exchanger coil having an inner row of tubes 12 and an outer row of tubes 14. A first end 16 of the two rows is held together by a clamp member 18 so that the first end of the two rows of tubes are held in a relatively fixed relationship to each other.

The illustrated coil includes three 90° bend areas at 20, 22 and 24 such that the final shape of the coil is substantially rectangular. A second end 26 of the coils is a free end in that the coils are not secured relative to one another at that point but instead are free to move relative to each other.

Figure 8:
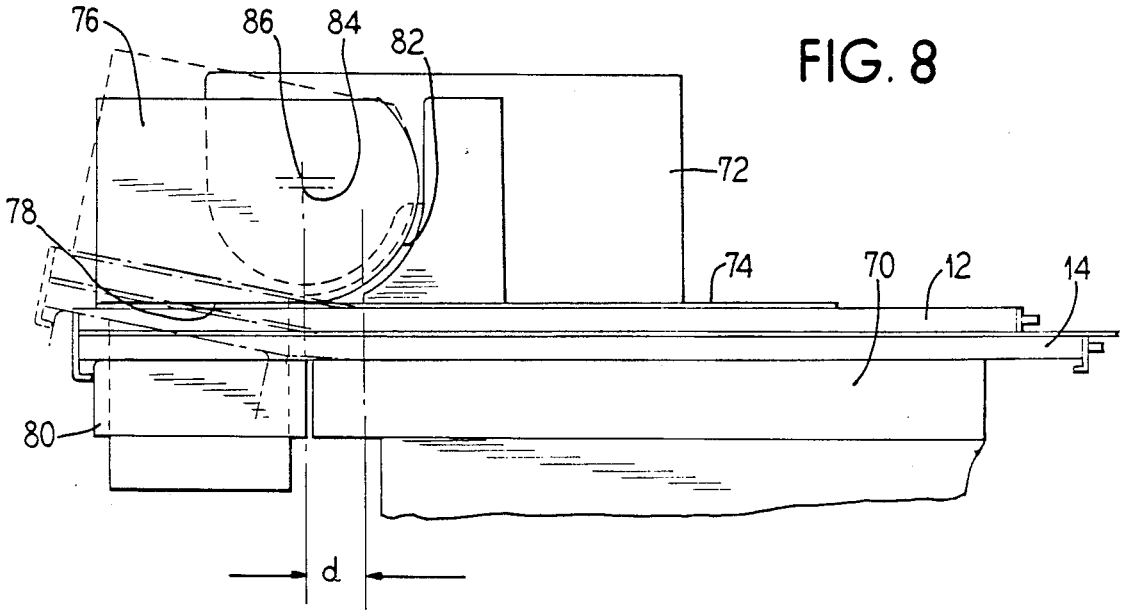
FIG. 8 is a schematic illustration of an alternative embodiment of the apparatus illustrating a perpendicular movement of the mandrel during initial rotation.

Prior to the bending procedure, the two rows 12, 14 of the coils are positioned one against the other with the first end 16 held together by the clamp member 18 and the second ends 26 are staggered, as seen in FIG. 8 in that the inside of the two rows of coils will have a smaller circumferential length than the outer row.

Figure 2:
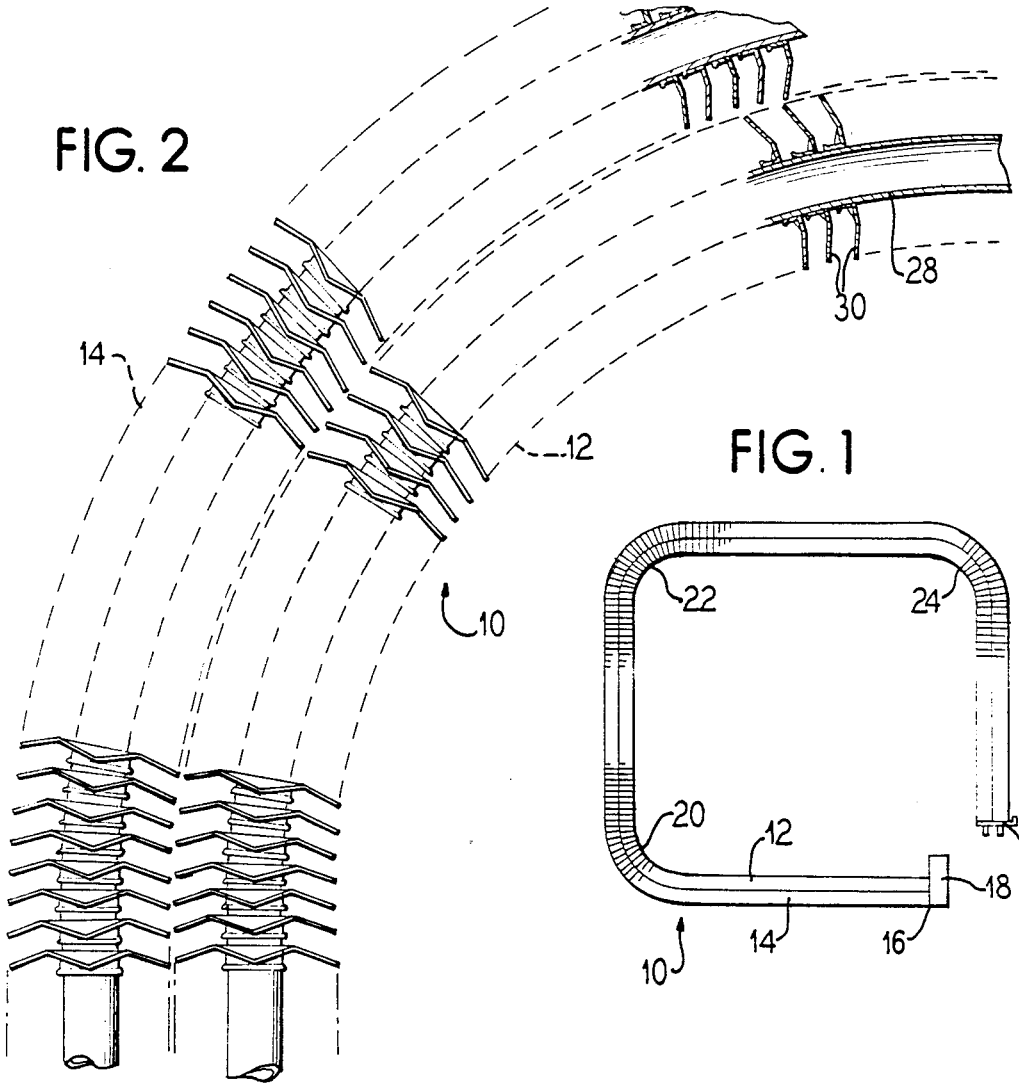
FIG. 2 is an enlarged view of a bent area of the coil of FIG. 1, partially shown in section.

FIG. 2 illustrates a bent corner of the coil 10 where it is seen that the coil is comprised of a plurality of tubes 28, each carrying a plurality of fins 30 which may be of an enhanced type, that is, a type that is not necessarily of a solid planar configuration which, it has been found is a more efficient heat transfer configuration.

Figure 3:
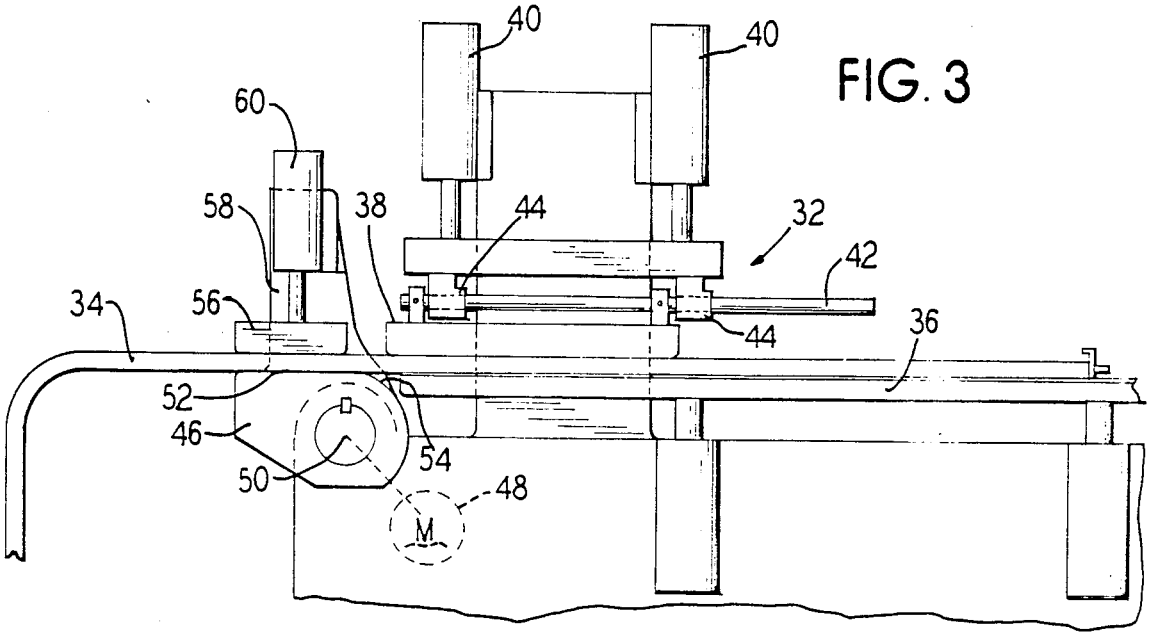
FIG. 3 is a side elevational view schematically showing an apparatus embodying the principles of the present invention.

An apparatus for providing the bends in the coil is schematically illustrated at 32 in FIG. 3. The apparatus shown is one embodiment of a means for performing the inventive method, but by no means is the exclusive arrangement for performing the method. For example another embodiment is illustrated in FIG. 8. Those skilled in the art, upon reading this disclosure will appreciate that there are a number of other arrangements which could be used to perform the method disclosed, all of which fall within the scope of our invention.

In FIG. 3 the apparatus is illustrated with a single row tube on fin heat exchanger coil 34. The apparatus 32 is comprised of an in-feed bed 36 which supports the coil in a coil plane and which is provided with a support surface for the coil which will permit relatively friction free movement of the coil over the surface such as a free rolling conveyor or other type of relatively friction free support. A hold-down 38 is provided which generally overlies the in-feed support bed 36 and which holds the coil against the support bed. The hold-down 38 is vertically adjustable, for example by means of pneumatic or hydraulic cylinders 40 so that a predetermined hold-down pressure is applied either to single row coils or double row coils or so that the hold-down can be spaced a predetermined distance from the support bed. The hold-down 38 is also free to move horizontally in the configuration shown in FIG. 3, along the longitudinal direction of the unbent coil so that the hold-down will move longitudinally with the coil as it is drawn through the apparatus.

In the example embodiment shown, the hold-down includes a guide bar 42 held in guide bearings 44 which permits the longitudinal movement of the hold-down while continuing to apply the appropriate pressure as controlled by the cylinders 40. A clamping device (not shown) may be included to grasp the free end of the coil stock to assist in loading the coil and moving the coil between bending operations.

A mandrel or spindle 46 is positioned adjacent to the hold-down bed 36. The mandrel is rotatable by means of a motor 48 about an axis 50. The mandrel has a first planar surface area 52 and an arcuate surface area or lobe 54 such that a linear portion of the tubes can be held against the planar surface area 52 and the arcuate surface portion 54 can be used to form a bend into the tubes upon rotation of the mandrel 46 about the axis 50.

A clamp member 56 is carried on an arm 58 rotatable synchronously with the mandrel, the clamp member 56 being movable toward and away from the planar surface area 52 of the mandrel by means of a pneumatic or hydraulic cylinder 60 to provide a predetermined clamping force of the coil against the mandrel or can be arranged to clamp to within a predetermined distance from the mandrel.

Once the coil is clamped against the mandrel and the mandrel begins to rotate about the axis 50, the coil 34 will begin to bend and eventually form around the arcuate surface area 54 of the mandrel away from the coil plane as is described in greater detail below.

Figure 4:
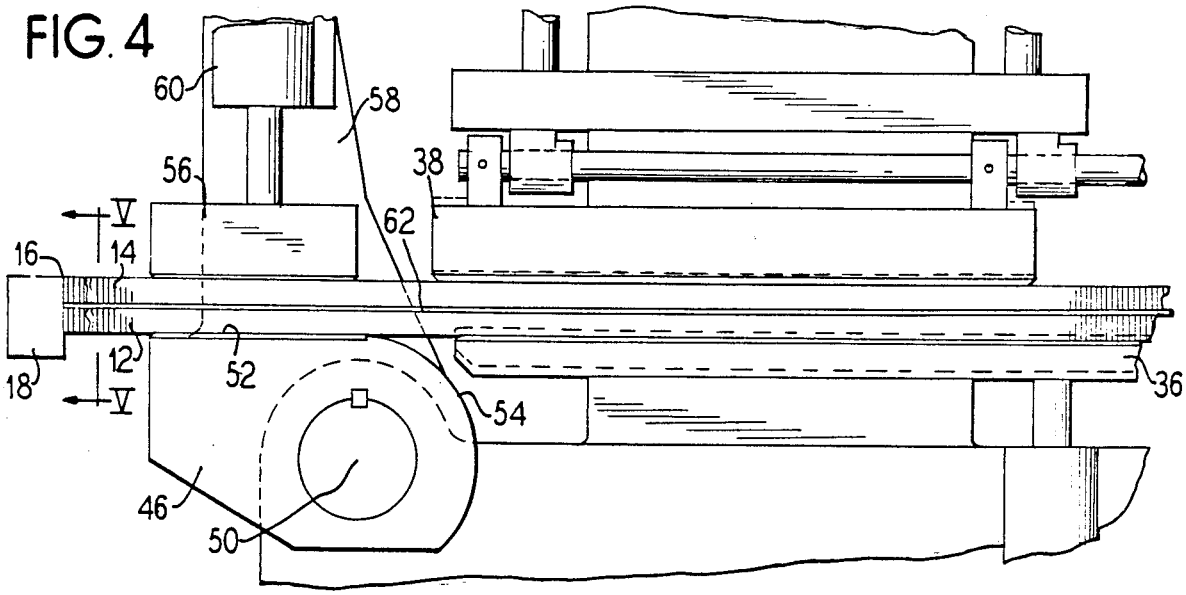
FIG. 4 is an enlarged partial side view of the mandrel and in-feed bed area of the apparatus as shown in FIG. 3.

In FIG. 4 there is illustrated the apparatus of FIG. 3 with a dual-row coil held in place. In this view, the inner row of coils 12 is positioned against the in feed bed 36 and planar surface 52 of the mandrel and the outer row 14 is laid on top of the inner row and is engaged by the hold-down 38 and clamp 56. The first end 16 of the coils is held relatively fixed by the clamp 18.

A plastic sheet 62 is positioned between the two rows of coils to permit the fins on the coils to slide past one another without binding or becoming engaged.

Figure 5:
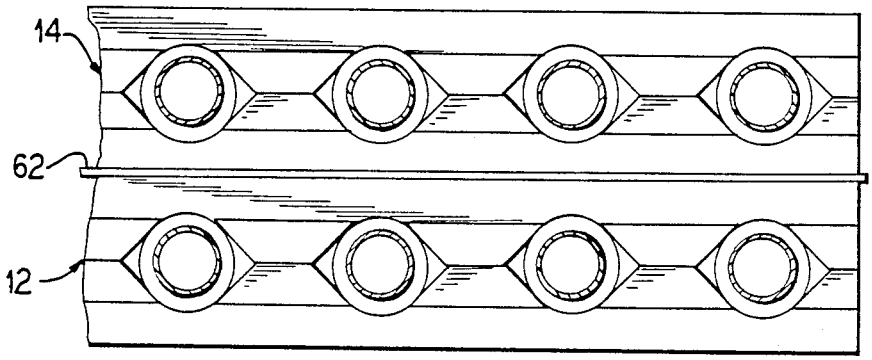
FIG. 5 is a sectional view of the tubes taken generally along the line IV—IV of FIG. 4.

FIG. 5 is a partial cross section showing the arrangement of the inner row of coils 12 and outer row of coils 14 separated by the plastic sheet 62. As is clearly seen, the coils are comprised of a plurality of tubes in side by side relationship.

Figure 6:
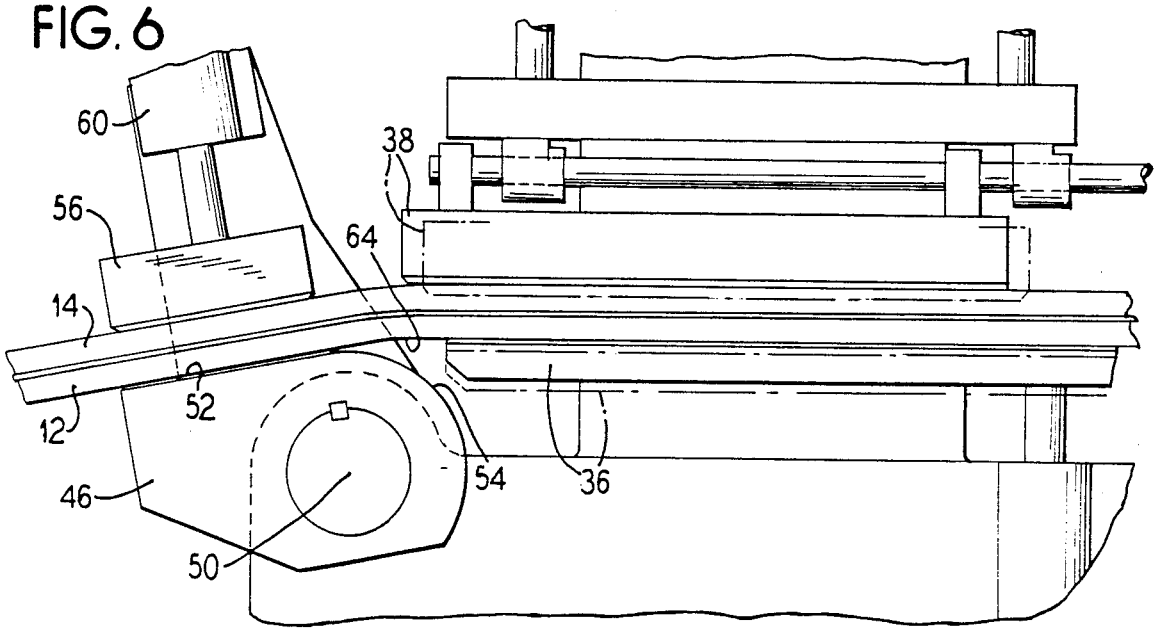
FIG. 6 is a side elevational view of the apparatus of FIG. 4 showing a perpendicular movement during the initial bending of the coil.

FIG. 6 illustrates the relative positions of the components of the apparatus during the initial rotational movement of the mandrel 46. As the mandrel begins to rotate about the axis 50, the in-feed bed 36 and hold-down 38 are moved upwardly, perpendicular to the coil plane or longitudinal axis of the linear portion of the coils such that an inner bend area 64 of the coils is moved away from pressing against the arcuate lobe 54 of the mandrel. This movement away from the mandrel takes up the elastic deformation of the coil so that the permanent deformation will be imparted in a pure rotational movement. This prevents an increase of the pressure against the fins during the bending process thereby avoiding deformation of the fins.

The upward movement of the in-feed bed 36 is shown by the full line presentation in the upper position and the phantom line presentation which was the original starting point. The hold-down 38 simultaneously moves upwardly with the in-feed bed 36 thereby maintaining the same clamping or holding pressure on the coils, and it also moves longitudinally with the coils as they are pulled around the mandrel, thus the hold-down 38 is shown in full lines in a vertically and horizontally translated position from the initial phantom line position.

Figure 7:
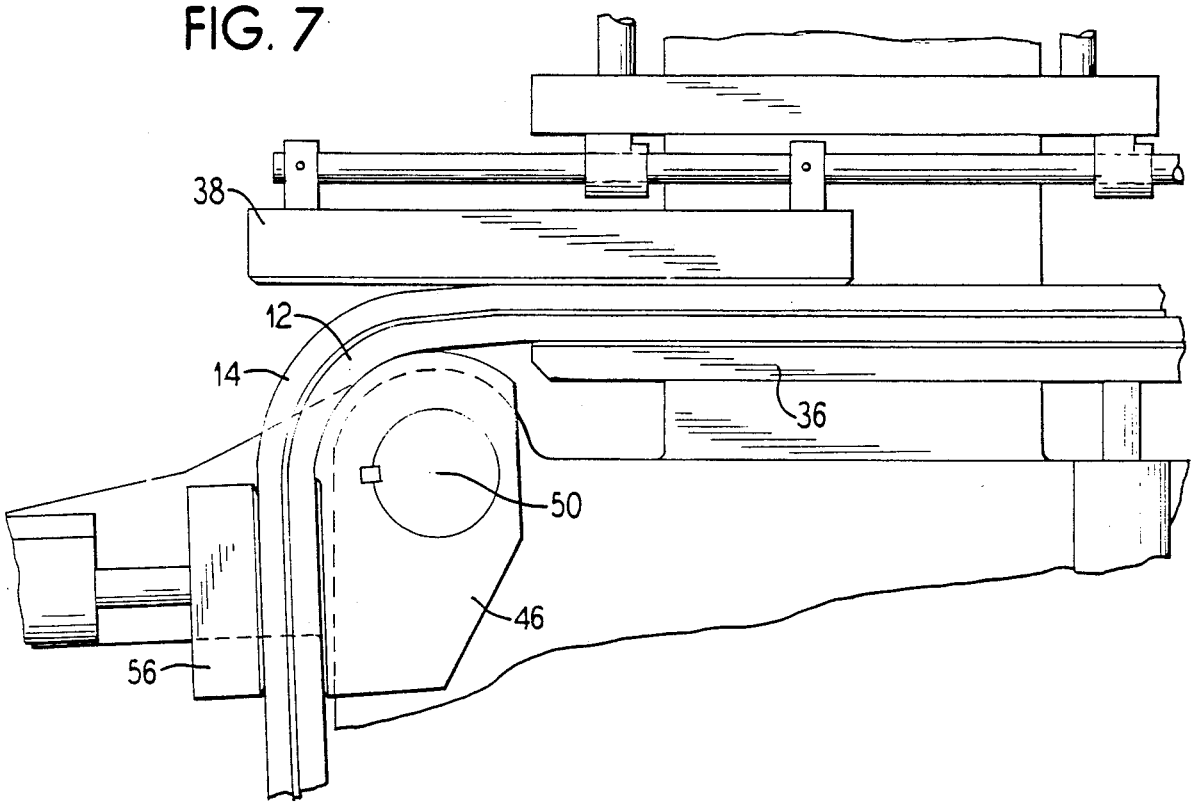
FIG. 7 is a side elevational view of the apparatus of FIG. 4 upon the completion of a 90° bend of the coil.

FIG. 7 illustrates the position of the apparatus when the coil has been bent through 90° where it is seen that the clamp 56 and mandrel 46 are rotated together through the 90°, the hold-down 38 has moved longitudinally with the coils and the in-feed bed 36 has remained at the slightly elevated position.

Once the coils have been bent 90°, the clamp 56 moves away from the coils to thereby release the clamping pressure thereon, and then the coils are moved longitudinally toward the released clamp while the mandrel and clamp rotate back to the initial starting position and the coils are indexed to the next bend location. The hold-down 38 is also moved back to an initial starting position so that upon the completion of indexing of the coils, the apparatus again assumes the configuration shown in FIG. 4 with the in-feed table 36 and hold-down 38 at the initial, lower starting position. FIG. 8 is a schematic illustration of an alternative embodiment of an apparatus for performing the method of the present invention in which the apparatus is essentially turned over and this time with a mandrel that is vertically movable as well as rotatable. Specifically, there are fixed in-feed bed 70 and hold-down 72 which can again apply a specific clamping pressure. This hold-down 72 does not move longitudinally with the coils as they are pulled through, but rather there is a plastic sheet 74 secured to a mandrel 76 and which moves with the mandrel to permit the coils to slide relative to the hold-down. In-feed bed 70 has means to permit relatively friction-free movement in the horizontal plane. The mandrel 76 is shaped substantially the same as the mandrel 46 of FIGS. 3, 4, 6 and 7, but it is turned upside down so that a flat planar surface 78 is facing downwardly and is opposed by a movable clamp 80. An arcuate lobe 82 is also provided for placing the bend in the coils.

In this embodiment the mandrel 76 is carried on a slidable pivot such that the mandrel 76 initially begins a rotation about an axis 84 and, during the first few degrees of rotation, the sliding of the axis occurs moving the axis to a position 86 about which the remainder of the rotation occurs.

Thus, this alternate embodiment again provides for a relative perpendicular movement relative to the coil plane between the mandrel-clamp and the feed bed hold-down during the initial few degrees of rotation of the mandrel. This lateral movement in a direction perpendicular to the plane of the coil away from the coil plane is in the direction of the coil as it is bent which reduces the pressures on the inner edge of the coil assembly as it is being bent. This limited lateral movement is to effect a pure rotational or bending moment on the coil to prevent damage to it. This is necessary because of offset between the center line of the mandrel and the end of the feed bed and is limited to the approximately first ten degrees of the bend when deformation of the coil has not exceeded the elastic limit of the coil. After approximately the first ten degrees the relative lateral position of the rotating spindle and the clamp remain fixed.

Figure 9:
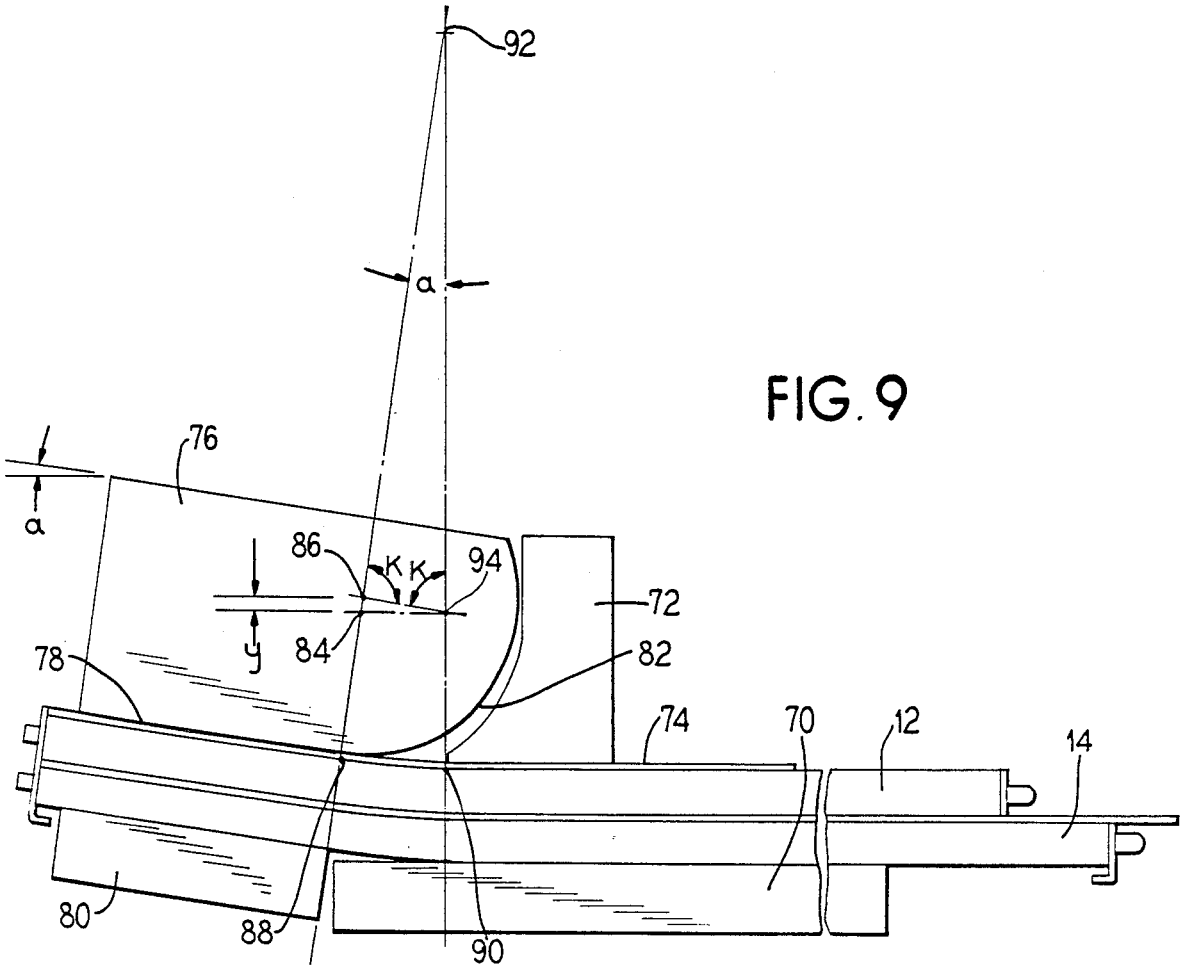
FIG. 9 is a side elevational view of the apparatus of FIG. 8 illustrating specific angles and dimension of initial bending and translating motion of the mandrel.
Figure 10:
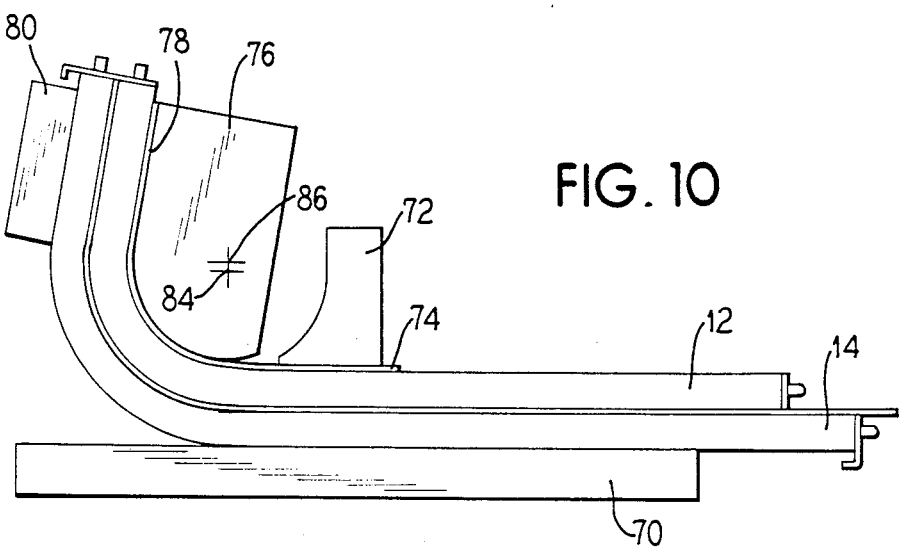
FIG. 10 is a side elevational view of the apparatus of FIG. 8 at the end of rotational movement of the mandrel.

FIG. 9 illustrates specific geometry involved in bending a coil according to the principles of the present invention. As illustrated in FIG. 8, the coils 12, 14 are clamped at one side of a bend area between the hold-down 72 and the in-feed bed 70 and at an other side of the bend the coils are clamped between the mandrel 76 and its associated clamp 80. The gap between the clamping locations is identified as d. Because the coil is clamped from both sides of the bend area, an opposing bending moment is applied from both sides. The gripping area upon the coil surfaces is distributed over the areas of each support member, rather than concentrating contact forces against the arc of the mandrel. To accomplish this, a certain portion of the bend area of the coil forms an arc without touching the mandrel. The geometry of the mechanism dictates that the pivot point of the mandrel must be allowed to move vertically with respect to the plane of the unbent coil. At a bend angle a (FIG. 9) the mandrel 76 is prevented from further upward movement, and the coil 12, 14 is allowed to wrap around the mandrel during the remainder of the bend. The angle a is adjusted so that permanent deformation or strain begins to occur within the coil at a tangent point 88. The coil forms a natural arc between a clamped point 90 and tangent point 88, which bends the coil to its elastic limit before allowed to contact the mandrel. As a result, the spring back or elasticity of the coil is taken up in a free arc, and the permanent deformation is controlled by contacting the arcuate lobe 82 of the mandrel 76. After the mandrel stops rotating at the end of its rotational movement as illustrated in FIG. 10, and the coils 12, 14 are allowed to spring back, the free arc between points 88 and 90 will become straight.

It has been determined that the mandrel 76 must move a distance y to clear the initial coil arc 88-90 which has a radius equal to the distance from a point 92 to either points 88 or 90. The two radius lines 92-88 and 92-90 are perpendicular to the coil at tangent points 88 and 90 and the two radius lines intersect at point 92 and at angle a. As mentioned above, the distance d is the horizontal spacing between a tip of the hold-down 72 and the tangent point 88 of the mandrel, which forms the end points of the free arc formed by the coil. The distance from a point 94 to 90 equals the distance from point 86 to 88 which is the same as the mandrel radius. Therefore triangle 86-92-94 is an isosceles triangle where angle k is equal to $(180-a)/2$ degrees. The distance y is equal to $d\,[\tan(90-k)]$ or, $y=d\,[\tan(a/2)]$. It has been determined that the angle a is typically 10° on air conditioning coils. Thus, the distance y would equal 0.0875 d. The distance d is determined primarily as a machine design consideration. The closer that the hold down clamp is positioned to the mandrel tangent, the smaller the offset y could be.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A method for bending a heat exchanger coil comprising the steps:

indexing a heat exchanger coil positioned in a coil plane by a support bed and a hold-down to a bending location so that a portion of said coil overlies a pivotable mandrel;

clamping said overlying portion to said mandrel while holding said coil against said support bed;

initiating bending of said coil by rotating said mandrel about an axis while providing relative separating movement between said mandrel and said entire support bed and hold-down in a direction perpendicular to said coil plane so that a bending portion of said coil is held away from said mandrel; and continuing the bending of said coil by only rotating said mandrel about said axis without further relative perpendicular movement between said mandrel and support bed.

2. A method according to claim 1, wherein said relative movement between said mandrel and said support bed in said perpendicular direction occurs only during the first ten degrees of rotation of said mandrel.

3. A method according to claim 1, wherein said mandrel is moved perpendicularly away from said coil plane to effect said relative movement.

4. A method according to claim 1, wherein said mandrel is rotated through 90° during the bending continuation.

5. A method according to claim 1, wherein said coil is serially indexed to a plurality of bending locations to provide multiple bands in said coils.

6. A method according to claim 1, wherein said heat exchanger coil comprises a dual row fin on tube coil, said method further including the steps of stacking a second row of finned tubes on a first row of finned tubes with a plastic sheet located therebetween and locking a first end of said tubes together, all prior to indexing said coil on said support bed.

7. An apparatus for bending a heat exchanger coil comprising:

an in-feed bed providing support for a heat exchanger coil in a coil plane;

a hold-down for engagingly holding said coil against said bed;

a rotatable mandrel having a planar surface portion and an arcuate surface portion;

a clamp synchronously rotatable with said mandrel and being movable relative to said mandrel to clamp said coil against said planar surface area of said mandrel; and means for effecting relative separating movement between said mandrel and said entire bed and hold-down in a direction perpendicular to said coil plane during an initial angle of rotation of said mandrel;

whereby the elastic deformation of said coil is taken up by the relative separating movement between the mandrel and the bed to provide permanent deformation of said coil.

8. An apparatus according to claim 7 wherein said means for effecting relative movement between said mandrel and said bed and hold-down comprises means for moving said mandrel away from said bed and hold-down such that said mandrel rotates about a movable axis.

9. An apparatus according to claim 7 wherein said hold-down and said clamp are each respectively movable relative to said bed and mandrel to permit the apparatus to accept both single row and double row heat exchanger coils.

10. An apparatus according to claim 7 wherein said means for effecting relative movement between said mandrel and said bed is operative to effect such movement during the first 10° of rotation of said mandrel.

11. An apparatus according to claim 7 wherein said hold-down and said clamp are each respectively positionable within a predetermined distance from said bed and said mandrel to provide nondamaging clamping of the heat exchanger coil.

12. An apparatus according to claim 7 wherein said mandrel arcuate surface portion engages said coil at a tangent point of said arcuate surface, said tangent point being a distance d from a clamping edge of said hold-down when said mandrel has its planar surface portion parallel to said coil plane, said relative movement between said bed and said mandrel being a distance y as said mandrel rotates through an angle a wherein $y=d\ (\tan (a/2))$.

13. An apparatus according to claim 7 wherein said hold-down is positioned above said bed and said clamp is positioned below said mandrel, said mandrel rotating to bend said coil upwardly, and said means for effecting relative movement between said mandrel and said bed is operative to move said mandrel upwardly away from said bed.

14. An apparatus according to claim 7 wherein there is provided means for effecting sliding movement of said coil relative to said bed as said mandrel rotates.

15. An apparatus for bending a heat exchanger coil comprising:

means for supporting a heat exchanger coil in a coil plane;

means for holding said coil against said support means;

a mandrel rotatable about an axis having a planar surface portion and an arcuate surface portion;

means for clamping said coil against said planar surface portion of said mandrel, said clamping means being rotatable with said mandrel about said axis; and means for effecting relative separating movement between said mandrel and said entire supporting means and holding means in a direction perpendicular to said coil plane during an initial angle of rotation of said mandrel;

whereby the elastic deformation of said coil is taken up by the relative movement between the mandrel and the bed to provide permanent deformation in a pure rotational moment.

16. An apparatus according to claim 15 wherein said mandrel arcuate surface portion engages said coil at a tangent point of said arcuate surface, said tangent point being a distance d from a closest point at which said coil is held against said support means, said relative movement between said bed and said mandrel being a distance y as said mandrel rotates through an angle a wherein $y=d\ (\tan (a/2))$.

* * * * *